US005129338A

United States Patent [19]

Wang

[11] Patent Number: 5,129,338

[45] Date of Patent: Jul. 14, 1992

[54] ADJUSTING DEVICE FOR A LOWER KNIFE OF A SEWING MACHINE

[76] Inventor: Shui-Nu Wang, No. 6, Nan Pin Road, Taichung, Taiwan

[21] Appl. No.: 704,611

[22] Filed: May 23, 1991

[51] Int. Cl.[5] ..... D05B 37/00

[52] U.S. Cl. ..... 112/126

[58] Field of Search ..... 112/122, 125, 126, 129, 112/161, 197, 235; 83/700, 856, 902

[56] References Cited

U.S. PATENT DOCUMENTS 2,224,070 12/1940 Walter ..... 83/700 X 2,896,712 7/1959 Brenner et al. ..... 83/700 X

*Primary Examiner*—Werner H. Schroeder

*Assistant Examiner*—Paul C. Lewis

[57] ABSTRACT

An adjusting device for a lower knife being disposed in a support of a sewing machine and including a sleeve fitted in the support and having a pair of slots, a bolt rotatably received in the sleeve and having one end extended outward of the sleeve, a knob fixed to the bolt, a slide having an inner thread engaged with the bolt and having a pair of ribs slidably engaged with the slots of the sleeve so that the slide can be guided to slide longitudinally in the sleeve by rotation of the knob, the lower knife is fixed to the slide.

4 Claims, 4 Drawing Sheets

ADJUSTING DEVICE FOR A LOWER KNIFE OF A SEWING MACHINE

BACKGROUND OF THE INVENTION (a) Field of the Invention

The present invention relates to an adjusting device, and more particularly to an adjusting device for a lower knife of a sewing machine.

(b) Description of the Prior Art

A sewing machine which is commercially available at present is shown in FIG. 1 and comprises an arm 10 disposed on a base 11 and a needle 12 extending downward from a free end portion of the arm 10 for conducting sewing operations. A board 14 is disposed on the base 11 and is located below the needle 12 and has a pawl 15 disposed therein for feeding the cloth to be sewed forward during operations. The sewing machine, for example, an overlock sewing machine for forming a hem or a selvage on the edge portions of a piece of cloth, comprises an upper knife 16 movable downward toward a lower knife 90 in order to scissor and to trim the edge portions of the cloth before sewing operations or before the formation of the hem. As shown in the drawing, the cutting edge of the upper knife 16 is tapered and has a lower edge extending downward beyond the upper edge of the lower knife 90. The upper knife 16 is biased by a spring (not shown) so that the lower edge of the upper knife 16 is biased to contact the lower knife 90 and so that the cloth can be trimmed by the knifes 16 and 90.

A conventional lower knife 90 is shown in FIG. 8 and is fixed to a rod 91 by a screw 92, the rod 91 is slidably received in a support 93 and can be fixed in place by a bolt 94. The width, for example, of the hem or the selvage to be formed on the edge portions of the cloth is varied according to the materials of the cloth and is determined by the distance between the needle 12 and the lower knife 90. The location of the lower knife 90 should be changed and adjusted in accordance with a selected width of the selvage. However, in order to adjust the position of the lower knife 90, an additional tool, such as a wrench, is required to unthread the bolt 94 so that the rod 91 can be moved relative to the support 93, and is required to thread the bolt 94 again so as to fix the rod 91 in place. This is very inconvenient.

The present invention has arisen to mitigate and/or obviate the afore-described disadvantages of the conventional sewing machines.

SUMMARY OF THE INVENTION

The primary objective of the present invention is to provide an adjusting device for a lower knife of a sewing machine in which the positions of the lower knife can be adjusted without additional tools.

In accordance with one aspect of the present invention, there is provided an adjusting device for a lower knife which is disposed in a support of a sewing machine and which includes a sleeve fitted in the support and having a first guiding means formed therein, a bolt rotatably received in the sleeve and having one end extended outward of the sleeve, a knob fixed to the end of the bolt and rotated in concert with the bolt, a slide having an inner thread formed therein for engagement with the bolt and having a second guiding means formed therein for slidably engagement with the first guiding means of the sleeve so that the slide can be guided to slide longitudinally in the sleeve by rotation of the knob, the lower knife is fixed to the slide so that the position of the lower knife can be adjusted by rotation of the knob.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
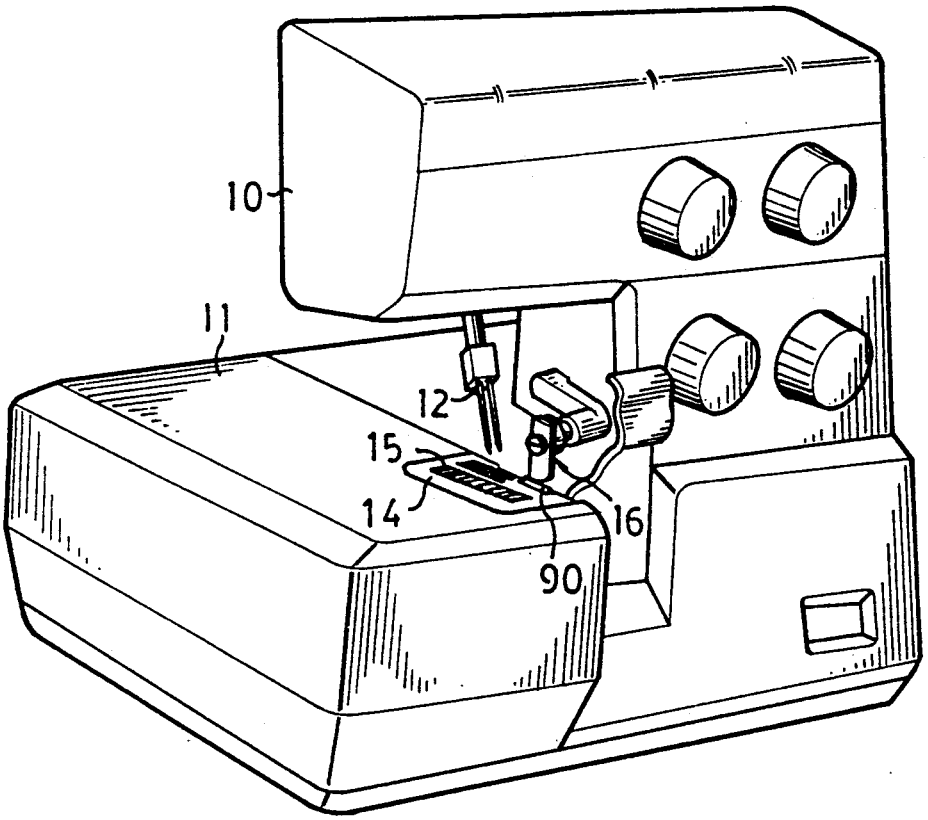
FIG. 1 is a perspective view of a sewing machine in which the adjusting device in accordance with the present invention is disposed therein.
Figure 3:
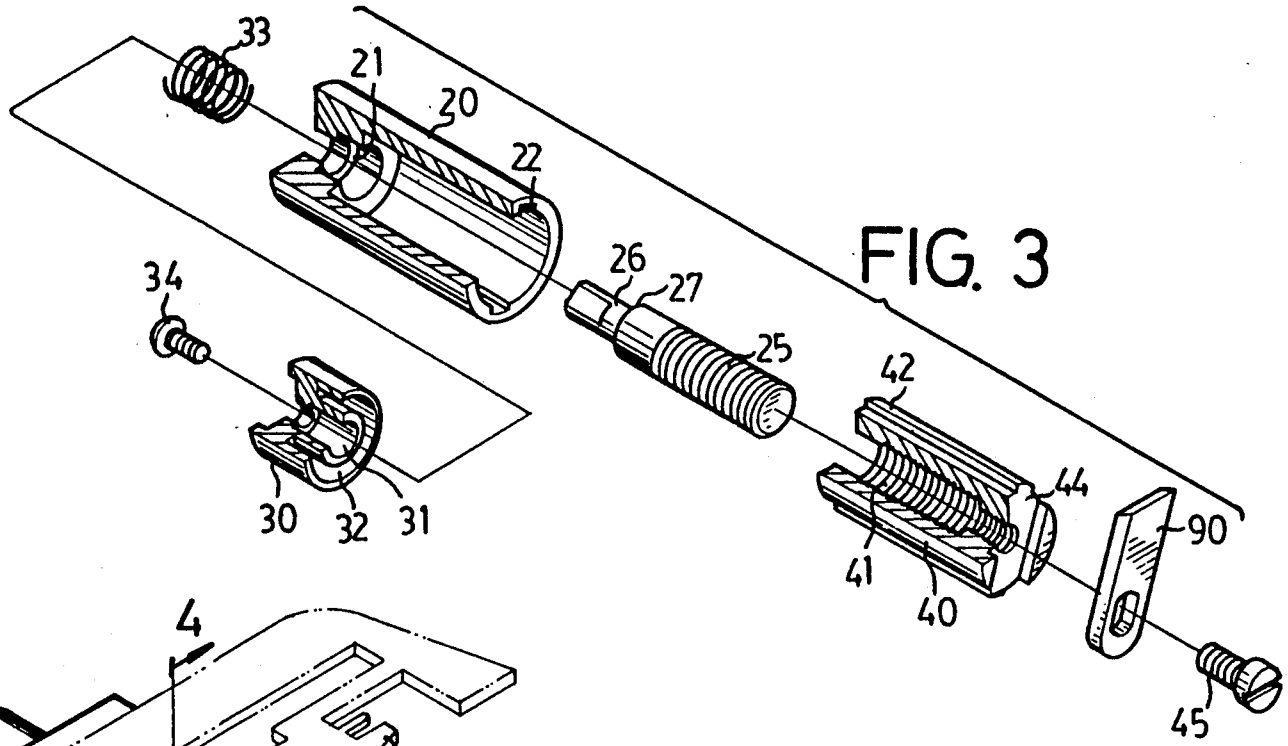
FIG. 3 is an exploded view of the adjusting device in accordance with the present invention.
Figure 2:
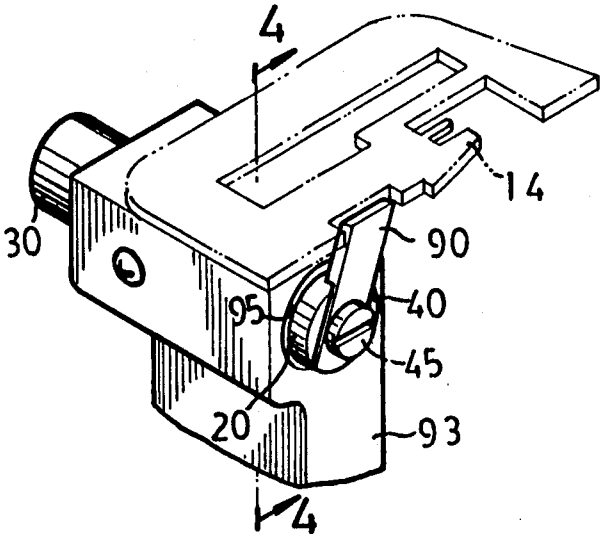
FIG. 2 is a partial perspective view of the lower knife and the support for the lower knife.
Figure 4:
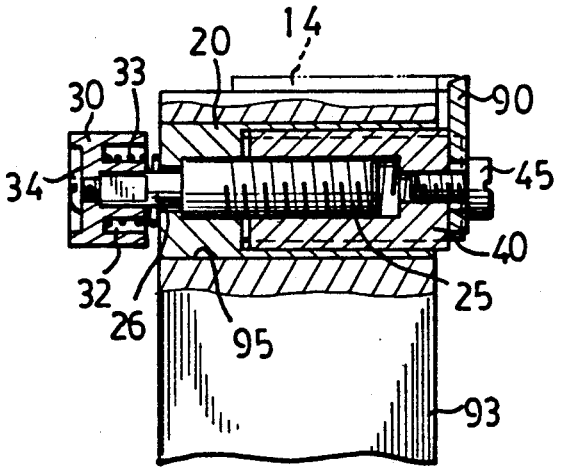
FIG. 4 and 5 are cross sectional views taken along lines 4—4 of FIG. 2.
Figure 5:
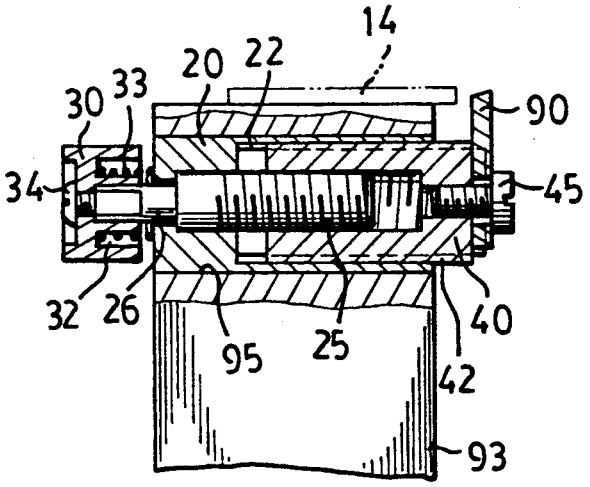

Referring to the drawings and initially to FIG. 1, a typical sewing machine comprises an arm 10 disposed on a bas 11 and a needle 12 extending downward from a free end portion of the arm 10 for conducting sewing operations. A board 14 is disposed on the base 11 and is located below the needle 12 and has a pawl 15 disposed therein for feeding the cloth to be sewed forward during operations. The sewing machine, for example, an overlock sewing machine comprises an upper knife 16 movable downward toward a lower knife 90 in order to scissor and to trim the edge portions of the cloth before sewing operations. The upper knife 16 is not related to the present invention and will not be described in further details. An adjusting device in accordance with the present invention is generally disposed in the base 11 and located below the board 14 and the pawl 15 for adjusting the positions of the lower knife 90.

Referring next to FIGS. 2 to 5, the support 93 which is fixed in the base 11 has a hole 95 formed therein for receiving the adjusting device. The adjusting device comprises a sleeve 20 fitted in the hole 95 of the support 93 and having a shoulder 21 formed in a first end portion thereof and having a pair of slots 22 longitudinal formed therein. A bolt 25 has an extension 26 formed on one end so that a shoulder 27 if formed therebetween. The extension 26 extends through the first end of the sleeve 20. The shoulders 21, 27 of the sleeve 20 and the bolt 25 are engaged with each other. A knob 30 has an aperture 31 and an annular recess 32 formed therein for receiving the extension 26 of the bolt 25 and a spring 33 respectively. The knob 30 and the extension 26 are fixed together by a bolt 34 so that the knob 30 and the bolt 25 rotate in concert and are rotatable relative to the sleeve 20. The spring 33 is biased between the knob 30 and the sleeve 20 for biasing the knob 30 away from the sleeve 20 so that the bolt 25 can be retained in place stably and so that the shoulder 21 of the sleeve 20 and the shoulder 27 of the bolt 25 can be in close contact with each other.

A slide 40 has an inner thread 41 formed therein for threadedly engagement with the bolt 25, and has a pair of ribs 42 longitudinally formed on the outer peripheral surface thereof for slidably engagement with the slots 22 of the sleeve 20 so that the slide 40 can be guided to slide longitudinally relative to the sleeve 20 when the bolt 25 is rotated. A notch 44 is formed in the free end portion of the slide 40 for receiving the lower knife 90 which is fixed to the slide 40 by a screw 45. Accordingly, the positions of the lower knife 90 can be easily adjusted by the knob 30 without an additional tool.

Alteratively, the slot can be formed in the outer peripheral surface of the slide 40, and the ribs can be formed in the inner peripheral surface o the sleeve 20 and can be slidably engaged with the slots of the slide so that the slide can also be guided to slide longitudinally in the sleeve.

Figure 6:
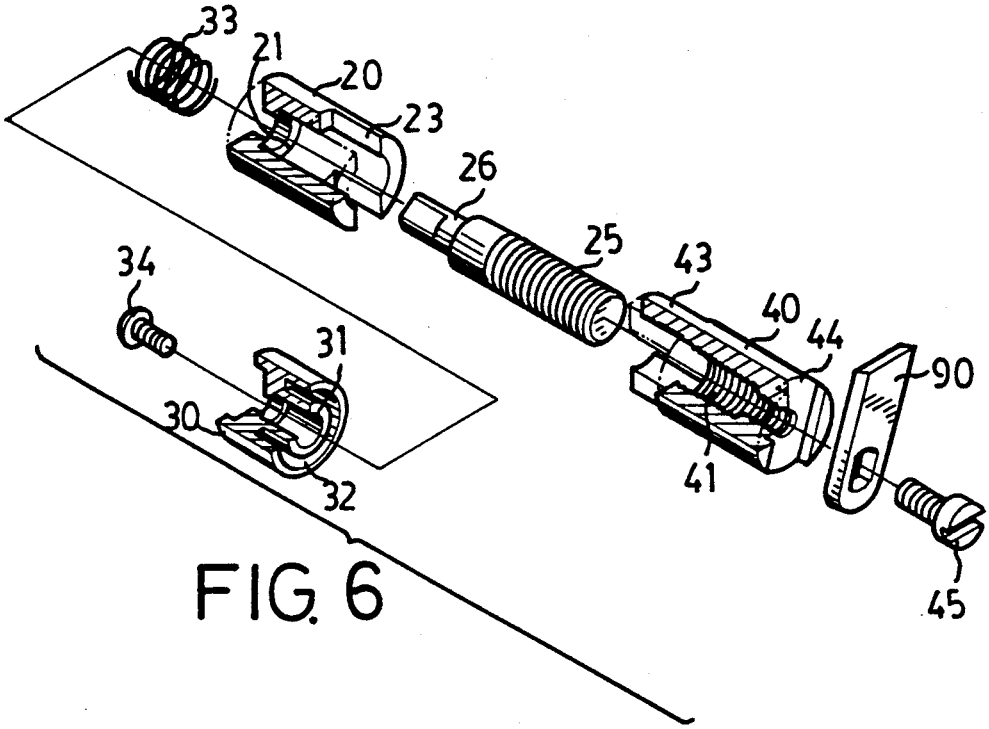
FIGS. 6 and 7 similar to FIGS. 3 and 4, illustrating another embodiment of the present invention.
Figure 7:
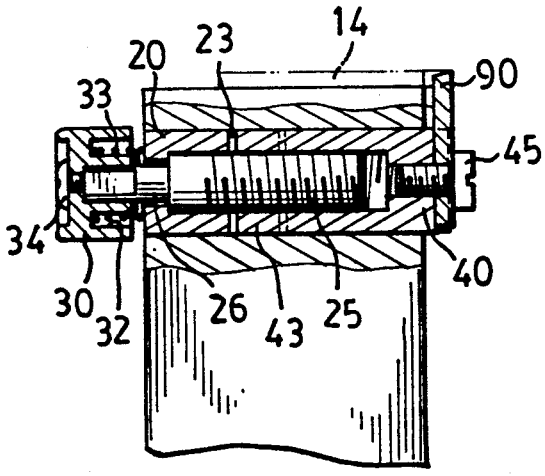
Figure 8:
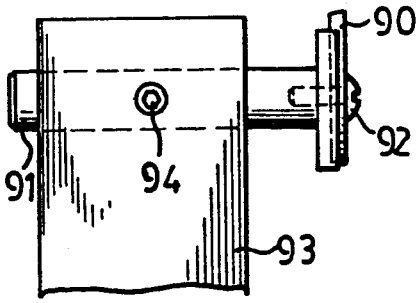
FIG. 8 PRIOR ART
FIG. 8 is a plane view illustrating a conventional lower knife of a sewing machine.

Referring next to FIGS. 6 and 7, illustrated is another embodiment of the present invention. The adjusting device also comprises a bolt 25 rotatably received in a sleeve 20 and has an extension 26 fixed to a knob 30 by a bolt 34, a spring 33 biased between the knob 30 and the sleeve 20 for pulling the bolt 25 in place, and a slide 40 slidably received in the sleeve 20 and threadedly engaged with the bolt 25. The lower knife 90 is fixed in the notch 44 of the slide 40 by a screw 45. A pair of channels 23 are longitudinally and axially formed in one end portion of the sleeve 20. A pair of legs 43 are longitudinally and axially formed on one end of the slide 40 and are slidably engaged in the channels 23 of the sleeve 20 respectively so that the slide 40 can be guided to slide longitudinally relative to the sleeve 20 when the bolt 25 is rotated.

Alternatively, the channels can be formed in the slide 40 and the legs can be formed on the sleeve and slidably engaged with the channels of the slide so that the slide can be guided to slide longitudinally along the sleeve.

Accordingly, the positions of the lower knife 90 can be easily adjusted by the knob 30 of the adjusting device in accordance with the present invention without additional tools.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An adjusting device for a lower knife of a sewing machine, said sewing machine comprising a support fixed in a base thereof, said adjusting device comprising a sleeve fitted in said support and having a first guiding means formed therein, a bolt rotatably received in said sleeve and having a first end extended outward of said sleeve, a knob fixed to said first end of said bolt and rotated in concert with said bolt, and extension formed on said first end of said bolt and extended outward of said sleeve, said knob having a hole and annular recess formed therein for receiving said extension of said bolts and a spring respectively, said spring being biased between said knob and said sleeve, a slide having an inner thread formed therein for engagement with said bolt and having a second guiding mans formed therein for slidable engagement with said first guiding means of said sleeve so that said slide can be guided to slide longitudinally in said sleeve by rotation of said knob, said lower knife being fixed to a first end of said slide so that a position of said lower knife can be adjusted by rotation of said knob.

2. An adjusting device for a lower knife of a sewing machine, said sewing machine comprising a support fixed in a base thereof, said adjusting device comprising a sleeve fitted in said support and having a first guiding means formed therein, a bolt rotatably received in said sleeve and having a first end extended outward of said sleeve, a knob fixed to said first end of said bolt and rotated in concert with said bolt, a slide having an inner thread formed therein for engagement with said bolt and having a second guiding means formed therein for slidable engagement with said first guiding means of said sleeve, said first guiding means including at least one slot longitudinally formed in said sleeve, said second guiding means including at least one rib longitudinally formed on an outer peripheral surface of aid slide and slidably engaged with said slot of said sleeve so that said slide can be guided to slide longitudinally along said sleeve by rotation by said knob, said lower knife being fixed to a first end of said slide so that a position of said lower knife can be adjusted by rotation of said knob.

3. An adjusting device for a lower knife of a sewing machine, said sewing machine comprising a support fixed in a base thereof, said adjusting device comprising a sleeve fitted in said support and having a first guiding means formed therein, a bolt rotatably received in said sleeve and having a first end extended outward of said sleeve, a knob fixed to said first end of said bolt and rotated in concert with said bolt, a slide having an inner thread formed therein for engagement with said bolt and having a second guiding means formed therein for slidable engagement with said first guiding means of said sleeve, said first guiding means including at least one channel longitudinally formed in an end portion of said sleeve, said second guiding means including at least one leg longitudinally formed on a second end portion of said slide and slidably engaged with said channel of said sleeve so that said slide can be guided to slide longitudinally along said sleeve by rotation of said knob, said lower knife being fixed to a first end of said slide so that a position of said lower knife can be adjusted by rotation of said knob.

4. An adjusting device for a lower knife of a sewing machine, said sewing machine comprising a support fixed in a base thereof, said adjusting device comprising a sleeve fitted in said support and having a first guiding means formed therein, a bolt rotatably received in said sleeve and having a first end extended outward of said sleeve, a knob fixed to said first end of said bolt and rotated in concert with said bolt, a slide having an inner thread formed therein for engagement with said bolt and having a second guiding means formed therein for slidable engagement with said first guiding means of said sleeve so that said slide can be guided to slide longitudinally in said sleeve by rotation of said knob, a notch being formed in a first end of said slide, said lower knife being received in said notch and being fixed to said slide by a screw so that said lower knife can be stably fixed to said slide and so that a position of said lower knife can be adjusted by rotation of said knob.

* * * * *